US005381594A

United States Patent [19]

Piccirillo et al.

[11] Patent Number: 5,381,594

[45] Date of Patent: Jan. 17, 1995

[54] MACHINE FOR THE AUTOMATIC DRAWING-IN OF WARP THREADS HAVING WARP BEAM TRUCK

[75] Inventors: Marcello Piccirillo, Sargans; Paul Beutler, Chur, both of Switzerland

[73] Assignee: Zellweger Uster AG, Uster, Switzerland

[21] Appl. No.: 862,753

[22] PCT Filed: Oct. 22, 1991

[86] PCT No.: PCT/CH91/00218

§ 371 Date: Jul. 28, 1992

§ 102(e) Date: Jul. 28, 1992

[87] PCT Pub. No.: WO92/07127

PCT Pub. Date: Apr. 30, 1992

[30] Foreign Application Priority Data

Oct. 23, 1990 [CH] Switzerland ..... 3384/90-0

[51] Int. Cl.[6] ..... B65H 1/00

[52] U.S. Cl. ..... 28/208; 28/201

[58] Field of Search ..... 28/196, 197, 201, 208, 28/202, 2; 242/68.4, 58.6, 129.5; 414/258, 233, 234, 235, 236

[56] References Cited

U.S. PATENT DOCUMENTS

| | | | |
|---|---|---|---|
| 2,706,056 | 4/1955 | Tally et al. | 28/201 |
| 3,280,442 | 10/1966 | Meierhofer | 28/203.1 |
| 3,433,499 | 3/1969 | Meierhofer | 28/201 |
| 3,650,419 | 3/1972 | Upsher et al. | 28/201 |
| 4,148,406 | 4/1979 | Kutzschebauch | 28/201 |
| 4,409,710 | 10/1993 | Kofler | 28/201 |
| 4,910,837 | 3/1990 | Fujiomoto et al. | 28/201 |

*Primary Examiner*—Clifford D. Crowder
*Assistant Examiner*—Larry D. Worrell, Jr.
*Attorney, Agent, or Firm*—Burns, Doane, Swecker & Mathis

[57] ABSTRACT

The machine contains a warp-beam truck (2) for the warp beam (3), a lifting device (4) and a drawing-in frame (5) provided for clamping a warp-thread layer (KF), the threading-up of which drawing-in frame (5) takes place separately from the drawing-in machine and which, after the threading-up, is transported to the drawing-in machine. The drawing-in frame (5) is detachably mounted on the lifting device (4) and, before the drawing-in, is transferred to the drawing-in machine in which it is displaceably arranged in the longitudinal direction of the latter. When it is displaced during the drawing-in operation, the drawing-in frame (5) is driven separately from the lifting device (4) and the warp-beam truck (2).

19 Claims, 5 Drawing Sheets

MACHINE FOR THE AUTOMATIC DRAWING-IN OF WARP THREADS HAVING WARP BEAM TRUCK

Figure 1:
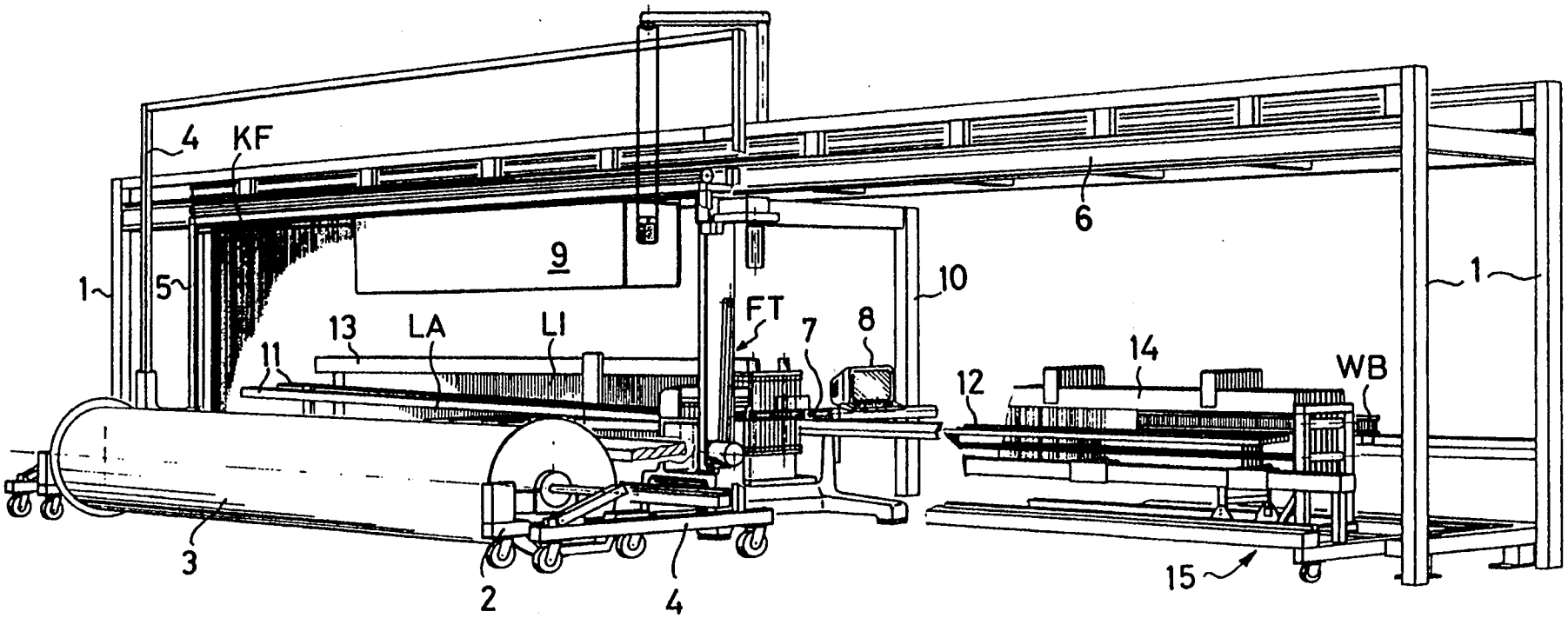

The invention relates to a machine for the automatic drawing-in of warp threads from a warp beam into the harness of a weaving machine, having a warp-beam truck for accommodating the warp beam, and a mechanism, designated below as lifting device, for accommodating a drawing-in frame provided for clamping a warp-thread layer, the threading-up of which drawing-in frame takes place separately from the drawing-in machine and which, after the covering, can be transported together with the lifting device and the warp-beam truck to the drawing-in machine and is arranged so as to be displaceable along the latter.

In the drawing-in machine USTER DELTA (USTER-registered trademark of Zellweger Uster AG) described in U.K. Pat. No. 1,290,385, the lifting device is formed by a so-called drawing-in truck. The drawing-in frame is firmly mounted on the drawing-in truck and forms with the latter a constructional unit. Apart from the fact that this unit is relatively bulky and heavy and is thus also expensive, a special guide, let into the floor, for the drawing-in truck plus the warp-beam truck must be provided along the drawing-in machine in order to ensure the requisite exact guidance of the warp-thread layer relative to the drawing-in machine.

This guide also represents a cost factor and of course has an inhibiting effect on every change of position of a drawing-in machine once it has been set up, which represents an impairment of its ease of operation.

The invention, then, is intended to make the warp-beam truck having the lifting device and the drawing-in frame substantially simpler and less expensive while also doing away with the need for a special guide in the floor.

This object is achieved according to the invention in that the drawing-in frame is detachably mounted on the lifting device, in that, before the drawing-in, the drawing-in frame is transferred from the lifting device to the drawing-in machine, and in that the drawing-in frame, during its displacement along the drawing-in machine, is driven separately from the lifting device and the warp-beam truck.

Owing to the fact that, in the drawing-in machine according to the invention, the drawing-in frame is no longer carried in front of a drawing-in truck, but rather is carried by the drawing-in machine during its adjusting movement along the latter, the need for an exceptionally strong construction for the drawing-in frame is dispensed with in the case of the lifting device. The lifting device consequently becomes simpler and less expensive. Special guides in the floor for the drawing-in truck are not necessary so that, in this respect too, a simplification and a reduction in price result.

Figure 3:
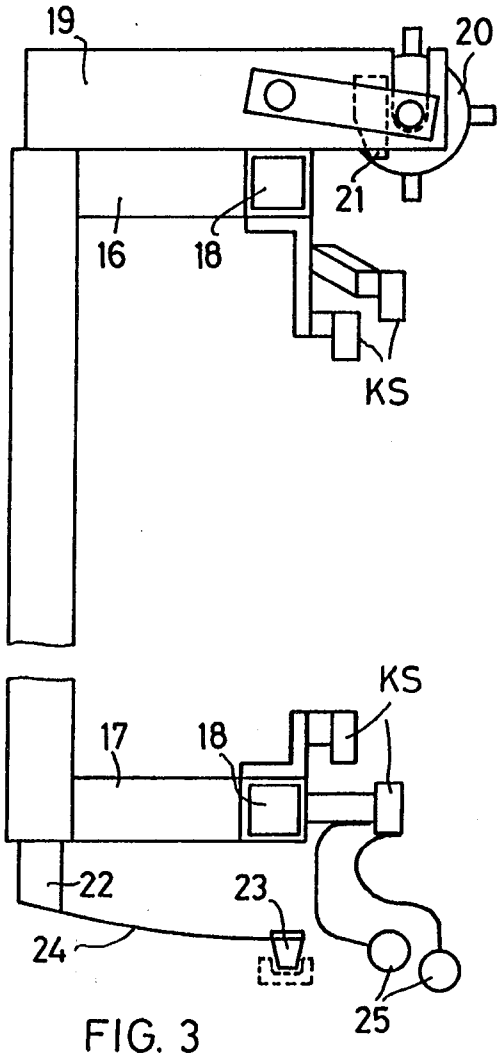
Figure 2:
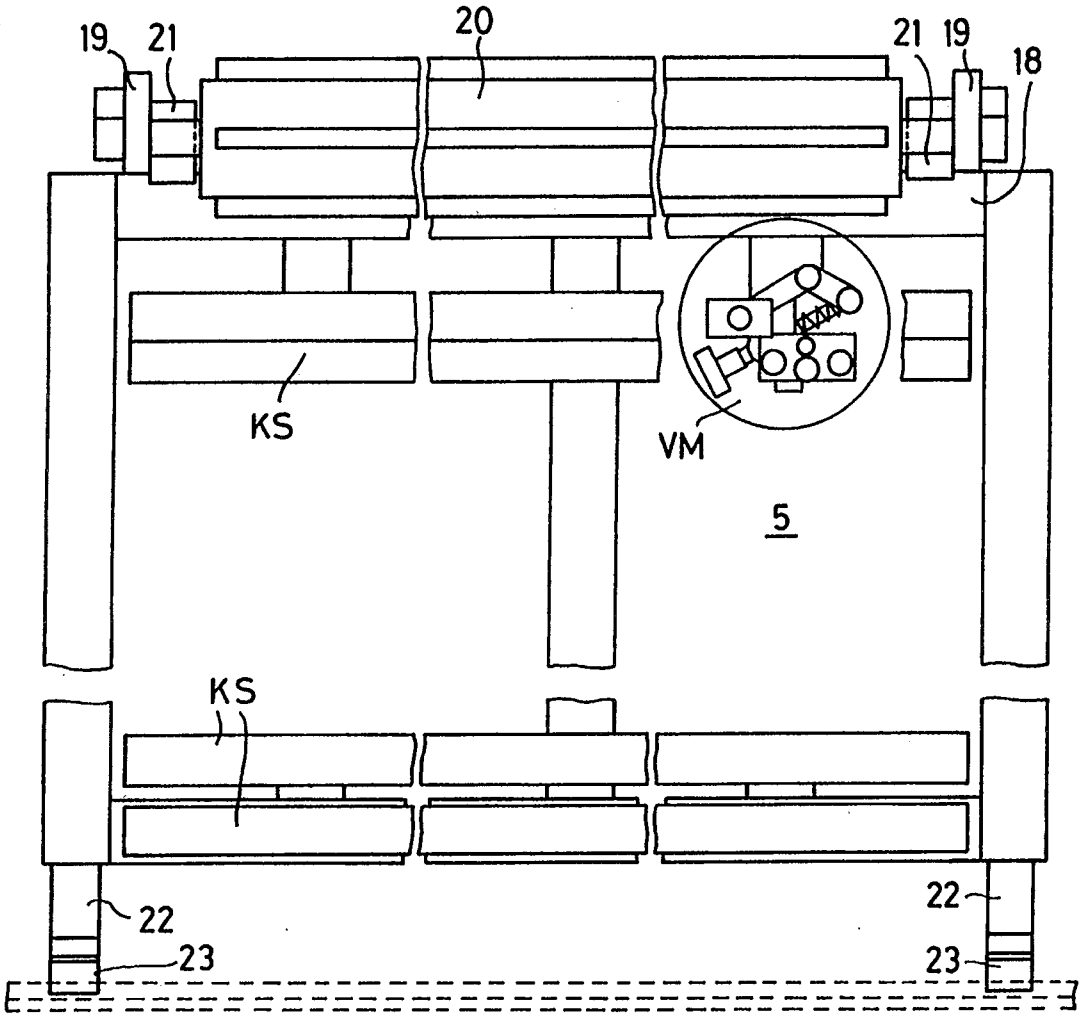
Figure 5:
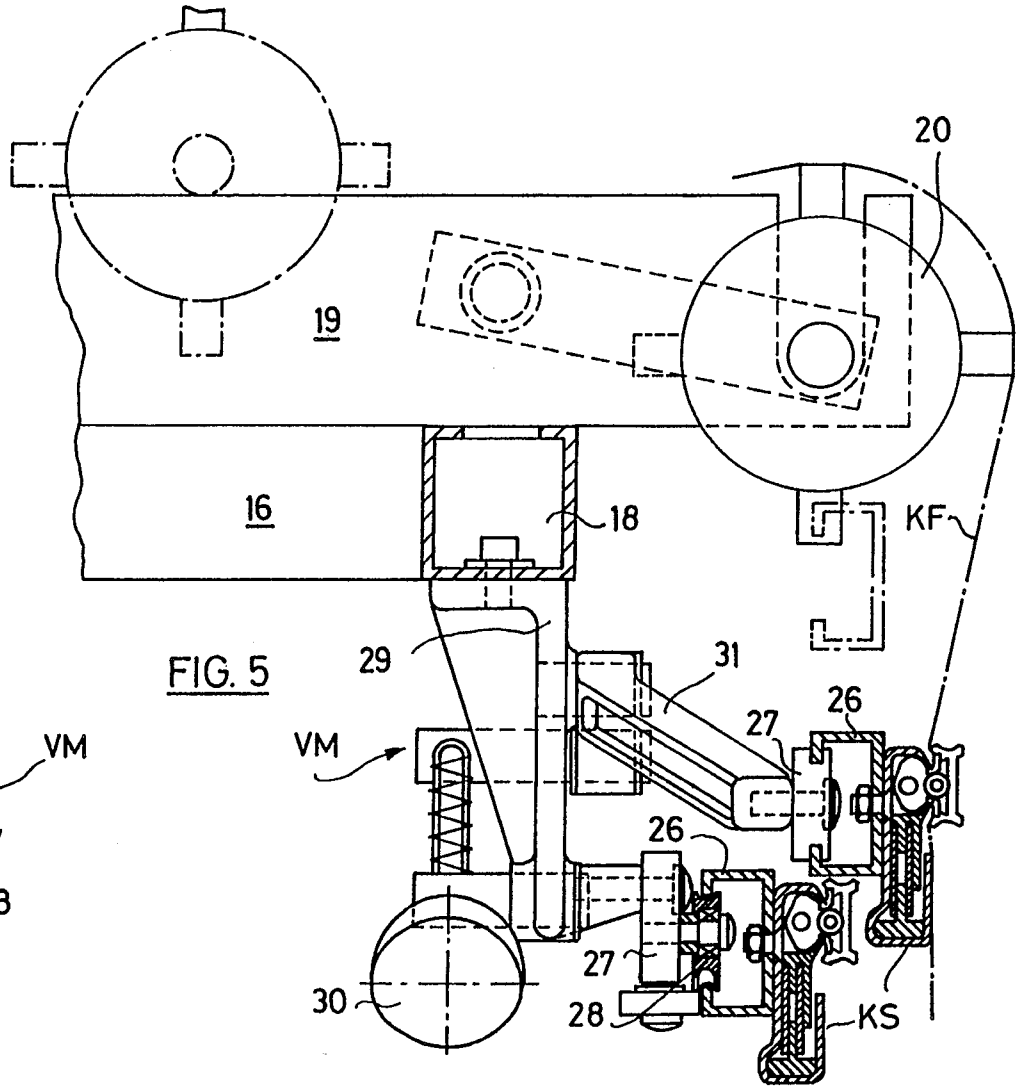
Figure 4:
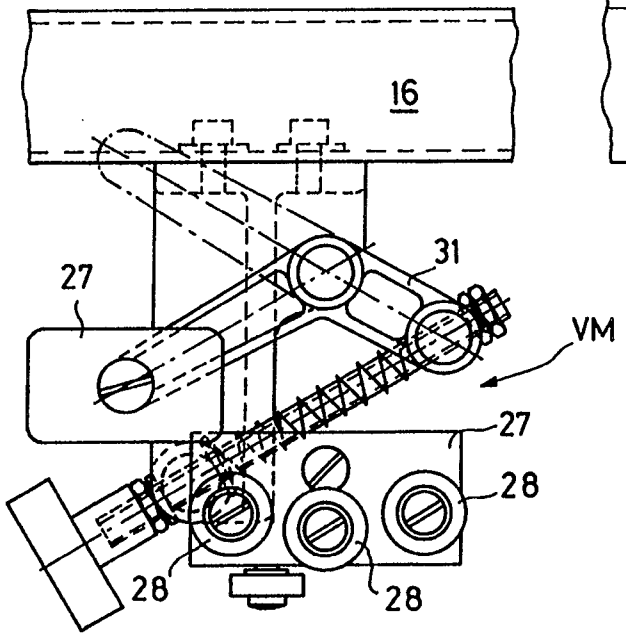
Figure 6C:
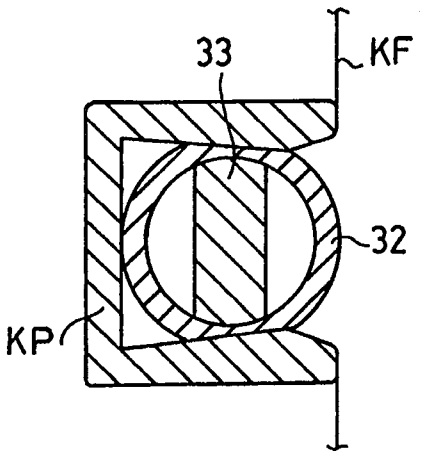
Figure 6B:
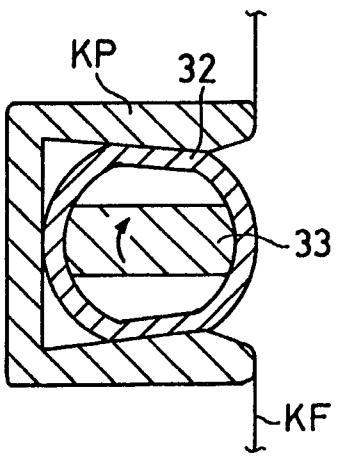
Figure 6A:
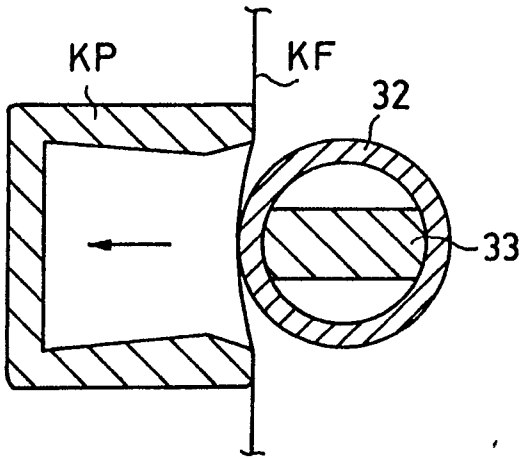
Figure 7:
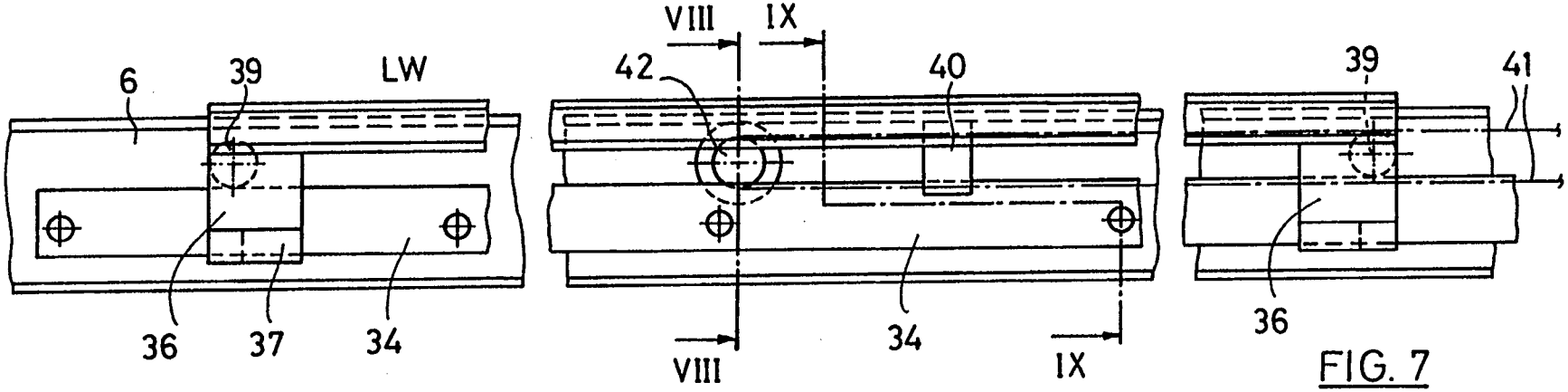
Figure 9:
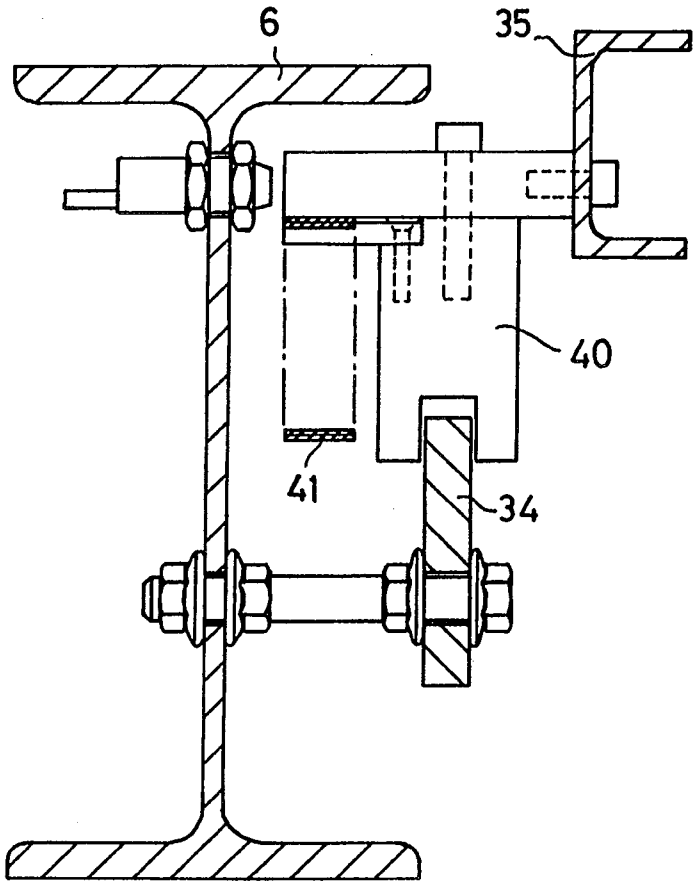
Figure 8:
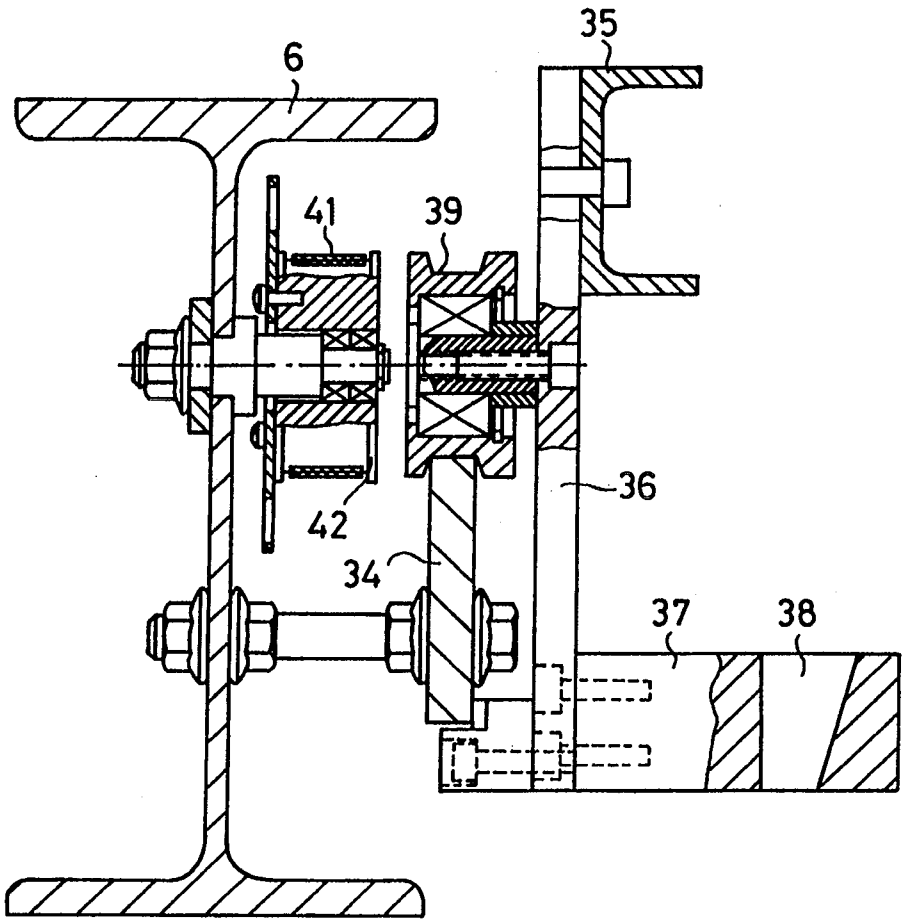

The invention is described in greater detail below with reference to an exemplary embodiment and the drawings, in which:

FIG. 1 shows a perspective overall representation of a drawing-in machine according to the invention, FIGS. 2, 3 show a representation of the drawing-in frame of the drawing-in machine of FIG. 1 in two elevations, FIGS. 4, 5 show a detail of FIG. 2 in two elevations, FIG. 6 shows a schematic representation of a detail variant of the drawing-in frame, FIG. 7 shows a front elevation of the transport mechanism of the drawing-in frame of FIG. 2, FIG. 8 shows a section along line VIII—VIII in FIG. 7; and FIG. 9 shows a section along line IX—IX in FIG. 7.

According to FIG. 1, the drawing-in machine consists of a mounting stand 1 and various subassemblies arranged in this mounting stand 1, each of which subassemblies represents a functional module. A warp-beam truck 2 with a warp beam,3 arranged thereon can be recognised in front of the mounting stand 1. The warp-beam truck 2 is coupled via the warp beam 3 to a mechanism, referred to below as lifting device 4, for accommodating and holding a drawing-in frame 5 on which the warp threads KF are clamped. This clamping is effected before the actual drawing-in and at a location separate from the drawing-in machine, the drawing-in frame 5 being positioned at the bottom end of the lifting device 4 directly next to the warp beam 3. For the drawing-in operation, the warp-beam truck 2 together with the warp beam 3 and the lifting device 4 is moved to the so-called setting-up side of the drawing-in machine and the drawing-in frame 5 is lifted up by the lifting device 4 and hung in the mounting stand 1, where it then assumes the position shown. The frame 5 is hung in a transport mechanism mounted on the front top longitudinal supporting means 6 of the mounting stand 1 (see FIG. 7).

During the drawing-in process, the frame 5 and the warp-beam truck 2 together with the warp beam 3 and the lifting device 4 are displaced from left to right in the longitudinal direction of the supporting means 6. During this displacement, the warp threads KF are directed past a thread-separating stage FT which has a device for selecting the warp threads and for cutting off the selected warp threads KF as well as a device for presenting the cut-off warp threads to a drawing-in needle 7, which forms a component of the so-called drawing-in module. The selecting device used in the warp tying machine USTER TOPMATIC can be used, for example, for the selection of the warp threads.

Next to the drawing-in needle 7 is a video display unit 8, which belongs to an operating station and serves to display machine functions and machine malfunctions and to input data. The operating station, which forms part of a so-called programming module, also contains an input stage for the manual input of certain functions, such as, for example, creep motion, start-stop, repetition of operations, and the like. The drawing-in machine is controlled by a control module which contains a control computer and is arranged in a control box 9. Apart from the control computer, this control box contains a module computer for every so-called main module, the individual module computers being controlled and monitored by the control computer. The main modules of the drawing-in machine, apart from the modules already mentioned—drawing-in module, yarn module, control module and programming module, are the heald, drop-wire, and reed modules.

The thread-separating stage FT, which presents the warp threads KF to be drawn in to the drawing-in needle 7, and the path of movement of the drawing-in needle 7, which runs vertically to the plane of the clamped warp threads KF, define a plane in the area of a support 10 forming part of the mounting stand 1. This plane separates the setting-up side already mentioned from the so-called taking-down side of the drawing-in machine. The warp threads and the individual elements into which the warp threads are to be drawn in are fed at the setting-up side, and the so-called harness (healds, drop wires and reed) together with the drawn-in warp threads can be removed at the taking-down side.

When all warp threads KF are drawn in and the frame 5 is empty, the latter is located, together with the warp-beam truck 2, the warp beam 3 and the lifting device 4 on the taking-down side and can be removed from the mounting stand 1.

Arranged directly behind the plane of the warp threads KF are the warp-stop-motion drop wires LA, behind the latter are the healds LI and further to the rear is the reed. The drop wires LA are stacked in hand magazines and the full hand magazines are hung in sloping feed rails 11, on which they are transported to the right towards the drawing-in needle 7. At this location they are separated and moved into the drawing-in position. Once drawing-in is complete, the drop wires LA pass on drop-wire supporting rails 12 to the taking-down side.

The healds LI are lined up on rails 13 and shifted on the latter to a separating stage. The healds LI are then moved individually into their drawing-in position and, once drawing-in is complete, are distributed over the corresponding heald shafts 14 on the taking-down side. The reed is likewise moved step-by-step past the drawing-in needle 7, the corresponding reed gap being opened for the drawing-in. After the drawing-in, the reed is likewise located on the taking-down side. A part of the reed WB can be recognized to the right next to the heald shafts 14. This representation is to be understood purely as an illustration, since the reed, at the position shown of the frame 5, is of course located on the setting-up side.

As further apparent from the figure, a so-called harness truck 15 is provided on the taking-down side. This harness truck 15, together with the drop-wire supporting rails 12, fixed thereon, heald shafts 14 and holder for the reed, is pushed into the mounting stand 1 into the position shown and, after the drawing-in, carries the harness having the drawn-in warp threads KF. At this moment, the warp-beam truck 2 together with the warp beam 3 and the lifting device 4 is located directly in front of the harness truck 15. By means of the lifting device 4, the harness is now reloaded from the harness truck 15 onto the warp-beam truck 2, which then carries the warp beam 3 and the drawn-in harness and can be moved to the relevant weaving machine or into an intermediate store.

The individual main modules of the drawing-in machine are composed of submodules which are in each case provided for certain functions. But this modular construction is not the subject matter of the present invention. Reference is made in this connection to Swiss Patent Application No. 3633/89. The submodule carrying and transporting the clamped thread layer is now to be described below, which submodule forms part of the yarn module.

The entire yarn module essentially consists of the warp-beam truck 2 and the lifting device 4 with its longitudinal drive, the drawing-in frame 5 with its transport mechanism and the thread-separating stage FT; the submodule carrying and transporting the clamped thread layer comprises the drawing-in frame 5 and its transport mechanism. The drawing-in frame 5 is shown in FIG. 2 in front elevation, as viewed from the drawing-in machine; FIG. 3 shows a left hand elevation of FIG. 2.

According to FIGS. 2 and 3, the drawing-in frame 5 is formed by an essentially approximately C-shaped stand of profiled tubes having a rectangular or square cross-section. The stand, at its top and bottom ends respectively, has one cross web 16 or 17 each, to whose free end a longitudinal beam 18 is fastened. These longitudinal beams 18 are provided as supporting means for clamping rails KS for clamping the thread layer. Two bearing means 19 projecting above the longitudinal beams 18 are arranged on the top cross web 16 in the area of the longitudinal ends of the drawing-in frame. The bearing means 19 serve to pivotably mount a brush beam 20 and each carry a wedge-shaped lug 21 projecting downwards. These lugs serve to hang the drawing-in frame 5 in its transport mechanism and to fix it in the same (see FIGS. 7 and 8). The brush beam 20 is known and will not be described here in detail. It serves to clamp the warp threads KF during clamping of the thread layer, in the course of which it is located in the position drawn in FIG. 3 and in FIG. 5 (in the latter in solid lines). The warp threads are guided at their ends via brushes of the brush beam 20 and are clamped by anticlockwise rotation of the brush beam 20. After clamping of the thread layer is complete, the brush beam 20 is pivoted into the position drawn in chain lines in FIG. 5.

Since the drawing-in frame 5 is hung in its transport mechanism only at its top cross web 16, guides are provided at its bottom end which engage in a corresponding guide rail of the drawing-in machine and serve to fix the drawing-in frame relative to the drawing-in machine. According to the representation, these guides each comprise a supporting bar 22 mounted so as to be adjustable and fixable in the vertical beams of the drawing-in frame 5, a sliding block 23 running in the guide rail and a leaf-spring-like connecting piece 24 via which the sliding block 23 is fixed to the supporting bar 22. The roller-like members 25 drawn at the bottom right in FIG. 3 are deflection bars for the warp threads delivered from the warp beam. With regard to FIG. 3, the warp beam is arranged to the left of the drawing-in frame 5 during the drawing-in process, the thread layer is vertically clamped between the clamping rails KS, and the actual drawing-in machine is located to the right of the drawing-in frame 5, which, as already mentioned, is guided in the supporting means 6 of the drawing-in machine (FIG. 1).

According to the representation, two pairs of clamping rails KS are provided for two thread layers at a distance from one another. With respect to each clamping-rail pair for a thread layer, one clamping rail KS is adjustable relative to the other clamping rail KS for clamping the thread layer. In the exemplary embodiment shown in FIGS. 2 and 3, the top clamping rail KS of the clamping-rail pair for the front or first thread layer adjacent to the drawing-in machine is adjustable, and the bottom clamping rail KS of the clamping-rail pair for the rear or second thread layer adjacent to the warp beam is adjustable, the adjusting mechanism VM being indicated in a circle in FIG. 2.

The clamping rails KS, and their fastening and adjusting mechanism VM are shown in FIGS. 4 and 5, FIG. 4 showing a front elevation in accordance with the detail circled in FIG. 2 and FIG. 5 showing a side elevation from the left. In FIG. 4 the clamping rails KS are omitted for better clarity. These clamping rails, which are also designated as an USTER thread-clamping system, are known from the USTER TOPMATIC tying machine and from the USTER DELTA drawing-in machine and are not described in more detail here. As apparent from FIG. 5, the clamping rails KS are carried by holding sections 26 which are in turn mounted on corresponding supporting plates 27, and in fact either directly like the right hand adjustable holding section in FIG. 5 or via small guide wheels 28 like the left hand fixed holding section in FIG. 5. At the non-adjustable clamping rail, the supporting plate 27 is fastened to a mounting stanchion 29 screwed to the longitudinal beam 18. At the adjustable clamping rail, the supporting plate 27 is fastened to a bell crank lever 31 mounted on this mounting stanchion 29 and adjustable against spring force by a screw 30. The maximum adjusting position is apparent from the holding section 26 drawn in chain lines in FIG. 5.

A plurality of adjusting mechanisms VM are provided along the length of the clamping rails, namely at the top clamping rail KS for the clamping-rail pair for the first thread layer and at the bottom clamping rail KS for the clamping-rail pair for the second thread layer. In addition, the clamping rails KS can be adjusted and fixed in the longitudinal direction relative to the supporting plates 27 in order to permit an optimum orientation of the warp threads KF. The warp threads preferably do not run strictly vertically between the clamping rails KS but at a slight angle, which facilitates the selection of the warp threads.

A particularly simple and advantageous variant of the clamping rails KS apparent from FIG. 5 is shown in FIG. 6, which variant, according to the representation, needs only three different individual parts, namely a C-shaped or U-shaped clamping section KP which is connected to the holding section 26 or to the supporting plates 27 (FIG. 5), an elastic tube 32 and a clamping bar 33 having a flattened cross-section. To firmly clamp a thread layer KF placed over the opening of the clamping section KP, the tube 32 and the pushed-in clamping bar 33, together with the thread layer, is pressed into the clamping section KP, the clamping bar 33 passing the opening of the clamping section edgewise (FIG. 6*a*). FIG. 6*b* shows the tube 32 and the clamping bar 33 pressed into the clamping section KP, the thread layer KF being deflected between the tube 32 and the inner surfaces of the clamping section KP. The clamp is now locked by the clamping bar 33 in the tube 32 being rotated through 90° about its longitudinal axis (FIG. 6*c*), which results in robust clamping being produced between the clamping bar 33 and the trapezoidal inner cross-section of the clamping section KP via tube 32.

The transport mechanism (already mentioned several times) for the drawing-in frame 5 is shown in FIGS. 7 to 9. FIG. 7 shows a front elevation in the direction of view from the warp-beam truck 2 (FIG. 1) to the drawing-in machine, FIG. 8 shows a section along line VIII—VIII and FIG. 9 shows a section along line IX—IX in FIG. 7.

The transport mechanism is formed by a travelling carriage LW which can be driven along the drawing-in machine and in which the drawing-in frame 5 is hung with its lugs 21 (FIGS. 2, 3). According to the representation, the top longitudinal supporting means 6, used for the guidance of the travelling carriage LW, of the drawing-in machine is formed by an H-section to which a travelling rail 34 is bolted at a distance away from it. The travelling carriage LW essentially consists of a supporting means 35 of suitable, torsionally rigid form, vertical holding plates 36 fastened to this supporting means and having horizontal bearing means 37 which have recesses 38 for receiving the lugs 21 of the drawing-in frame 5, travelling wheels 39 which are mounted on the holding plates 36 and which run on the travelling rail 34 and embrace the latter on both sides, and a driver block 40 on which a drive means acts. The latter is formed by a toothed belt 41 which is run around pulleys 42 mounted on the longitudinal supporting means 6 and is positively connected to the driver block 40. Two belt pulleys 42 are provided, only one of which is shown in FIG. 7 and one of which is driven. The drive of this belt pulley and thus of the toothed belt 41 and of the entire drawing-in frame 5 is effected stepwise by a motor. This motor is controlled by the device for selecting the warp threads, which device forms part of the thread-separating stage FT (FIG. 1). The drawing-in frame in turn controls the follow-up of the lifting device 4 together with the warp-beam truck 2 and the warp beam 3 (FIG. 1).

What is claimed is:

1. System for automatically drawing-in warp threads from a warp beam into a harness of a weaving machine, comprising a warp-beam truck that includes a warp beam, a drawing-in machine for drawing-in warp threads, a drawing-in frame for clamping a warp-thread layer, the drawing-in frame being detachably mounted on a lifting device, the drawing-in frame being threaded up with warp threads and thereafter transported together with the lifting device and the warp-beam truck to a mounting stand of the drawing-in machine for drawing-in of the warp threads, the drawing-in frame being transferrable from the lifting device to the mounting stand before drawing-in of the warp threads, and means for moving the drawing-in frame along the mounting stand separately from the lifting device and the warp-beam truck.

2. System according to claim 1, including a travelling carriage on which the drawing-in frame is positioned for movement along the mounting stand.

3. System according to claim 2, including means for hanging the drawing-in frame on the travelling carriage.

4. System according to claim 2, including a travelling rail which is mounted on the mounting stand and on which the travelling carriage is guided by way of travelling wheels.

5. System according to claim 4, wherein the travelling carriage is connected to said means for moving the drawing-in frame along the mounting stand, said means for moving including a motor-driven toothed belt.

6. System according to one of the claim 3, including fastening means positioned at a top edge of the drawing-in frame for hanging the drawing-in frame on the travelling carriage and guide means positioned at a bottom edge of the drawing-in frame for guiding the drawing-in frame.

7. System according to claim 6, wherein the guide means includes a sliding block for engaging a guide.

8. System according to claim 7, including flexible connecting means positioned between the sliding block and the drawing-in frame.

9. System according to claim 1, including clamping rails positioned on the drawing-in frame for clamping the warp-thread layer, the clamping rails including a clamping section open at one side and having an inner surface, a clamping member for being pressed into the clamping section and for being locked and unlocked in the clamping section, and an elastic element arranged between the clamping member and the inner surface of the clamping section.

10. System according to claim 9, wherein the clamping member is a flattened clamping bar having one cross-sectional dimension that is larger than another cross-sectional dimension, and the inner surface of the clamping section being provided with locking projections that face one another, the larger cross-sectional dimension of the clamping bar being larger than a distance between the locking projections and the smaller cross-sectional dimension being smaller than the distance between the locking projections.

11. System according to claim 10, wherein the elastic element is a tube.

12. System for automatically drawing-in warp threads from a warp beam into a harness of a weaving machine, comprising a warp thread drawing-in machine that includes a mounting stand, a warp-beam truck carrying a warp-beam and movable to the mounting stand, a drawing-in frame for clamping warp threads, a lifting device for detachably holding the drawing-in frame and for lifting the drawing-in frame, the lifting device being coupled to the warp-beam truck, a travelling carriage positioned on the mounting stand for removably receiving the drawing-in frame, and means for moving the travelling carriage along the mounting stand separately from the warp-beam truck when the drawing-in frame is mounted on the travelling carriage to allow drawing-in of the warp threads.

13. System according to claim 12, wherein said drawing-in frame includes a bearing member and a lug extending from the bearing member, said travelling carriage including a recess for receiving the lug to removably mount the drawing-in frame on the travelling carriage.

14. System according to claim 13, including a guide member extending from the drawing-in frame for being positioned in a groove in order to guide the drawing-in frame during movement of the travelling carriage.

15. System according to claim 12, including a travelling rail connected to the mounting stand, and two travelling wheels disposed on the travelling carriage for rolling along the travelling rail.

16. Apparatus for automatically drawing-in warp threads from a warp beam of a warp beam truck into a weaving machine harness, comprising a drawing-in module that includes at least one needle for drawing-in a warp thread, a mounting stand in which is arranged the drawing-in module, mounting means for mounting onto the mounting stand a drawing-in frame which has a warp-thread layer clamped thereon so that a drawing-in frame held in a lifting device is detachable from the lifting device and transferable to the mounting means of the mounting stand, and a drive device for effecting movement of the mounting means along the mounting stand during a drawing-in operation in a manner separate from the warp beam truck and the lifting device.

17. Apparatus according to claim 16, wherein the mounting stand includes a longitudinal supporting rail to which is connected a travelling rail.

18. Apparatus according to claim 17, wherein said mounting means includes a travelling carriage which is movably mounted on the travelling rail, said travelling carriage including recesses for receiving lugs extending from the drawing-in frame.

19. Apparatus according to claim 16, including a guide rail disposed in drawing-in machine for receiving a guide extending from the drawing-in frame to guide the drawing-in frame along the drawing-in machine during movement by the drive device.

* * * * *